United States Patent [19]

Boeckmann

[11] Patent Number: 5,072,571

[45] Date of Patent: Dec. 17, 1991

[54] ZIPPERED FILM PLURAL SHEET STRIP GUIDE SYSTEM AND METHOD FOR ZIPPERED FILM FOR FORM, FILL AND SEAL PACKAGE MAKING MACHINES

[75] Inventor: Hugo Boeckmann, Arlington Heights, Ill.

[73] Assignee: Zip-Pak Incorporated, Northbrook, Ill.

[21] Appl. No.: 484,509

[22] Filed: Feb. 26, 1990

[51] Int. Cl.[5] ..... B65B 9/02; B65B 61/18

[52] U.S. Cl. ..... 53/133.4; 53/139.2; 53/553; 53/389.3

[58] Field of Search ..... 53/128, 133, 140, 389, 53/410, 412, 450, 451, 550, 551, 552, 553, 554, 555, 133.4, 139.2, 389.3; 493/195, 224, 244, 923; 242/55, 57.1, 58

[56] References Cited

U.S. PATENT DOCUMENTS

| | | | |
|---|---|---|---|
| 2,162,230 | 6/1939 | Salfisberg | 53/554 X |
| 3,383,269 | 5/1968 | Kopp | 53/554 X |
| 3,451,187 | 6/1969 | Massey et al. | 53/554 X |
| 3,815,317 | 6/1974 | Tuss | 53/551 X |
| 4,085,560 | 4/1978 | McClosky | 493/224 X |
| 4,709,533 | 12/1987 | Ausnit | 53/451 |
| 4,727,709 | 3/1988 | Zieke et al. | 53/551 |
| 4,745,731 | 5/1988 | Talbott et al. | 53/451 |
| 4,769,974 | 9/1988 | Davis | 53/554 X |
| 4,790,126 | 12/1988 | Boeckmann | 493/213 X |
| 4,829,745 | 5/1989 | Behr et al. | 53/451 |
| 4,840,012 | 6/1989 | Boeckmann | 53/552 X |

*Primary Examiner*—John Sipos

*Attorney, Agent, or Firm*—Hill, Van Santen, Steadman & Simpson

[57] ABSTRACT

Plural strips of package making sheet material are directed toward a forming and filling tube in a form, fill and seal machine for making packages, and the strips are guided into cooperative relation along the tube for joining of the strips into tubular form about the tube. In a preferred arrangement, the strips are derived by slitting a continuous single sheet of package making material, provided with complementary zipper profiles along the slit margins of the strips. A three-bar guidance system is provided for guiding each of the strips cooperatively to the forming and filling tube.

9 Claims, 2 Drawing Sheets

ZIPPERED FILM PLURAL SHEET STRIP GUIDE SYSTEM AND METHOD FOR ZIPPERED FILM FOR FORM, FILL AND SEAL PACKAGE MAKING MACHINES

BACKGROUND OF THE INVENTION

The present invention relates in general to the bag or package making art utilizing form, fill and seal machines, and is more particularly directed to new and improved sheet strip guide means for zippered film and method according to which plural strips of zippered material are guided into cooperative relation about a forming and filling tube in the machine.

Various and sundry mechanisms have been proposed heretofore for guiding the bag or package making sheet material, generally in the form of a plastic film, often equipped with reclosable fastener profile means, into running relation along a forming and filling tube in a form, fill and seal machine wherein successive packages are formed and filled with product contents below the lower end of the tube.

In my earlier U.S. Pat. No. 4,869,048 is disclosed a conventional forming collar about the upper end portion of the forming and filling tube by which a single sheet of material is guided into position about the tube and shaped into tubular package making form. A particular feature of that patent is in the means for stretching the tubularly shaped material to avoid wrinkling in the cross seals when forming it into successive packages.

In my earlier U.S. Pat. No. 4,790,126 there is also disclosed a zipper profile equipped single sheet guiding structure and including a tracking bar mechanism from which the tracked sheet is led to a more or less conventional forming or shaping collar or shoulder by which the sheet is guided into tubularly wrapped relation about the forming and filling tube.

Insofar as details thereof are applicable, the disclosures of the two above U.S. patents are incorporated herein by reference, so that a more streamlined description focusing on particulars of the present invention may be pursued.

SUMMARY OF THE PRESENT INVENTION

An important object of the present invention is to provide new and improved method of and means for guiding plural strips of package making sheet material into position relative to a forming and filling tube in a form, fill and seal machine.

Another object of the invention is to provide a new and improved mechanism and method for guiding separate strips slit from a supply sheet of package making material into cooperative tubular relation about a form and fill nozzle or tube in a form, fill and seal machine.

Still another object of the invention is to provide such a means and method comprising a new and improved guide bar mechanism which avoids the need for the usual forming collar or shoulder structure.

Pursuant to the present invention there is provided in combination in a form, fill and seal package making machine, having a forming and filling tube, means for directing plural strips of package making sheet material toward the tube, and means for guiding the strips into cooperative relation along the tube for joining of the strips into tubular form about the tube.

There is also provided by the present invention a method in a form, fill and seal machine for forming packages comprising, directing plural strips of package making sheet material toward a forming and filling tube, and guiding the strips into cooperative relation along the tube for joining of the strips into tubular form about the tube.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION

Figure 1:
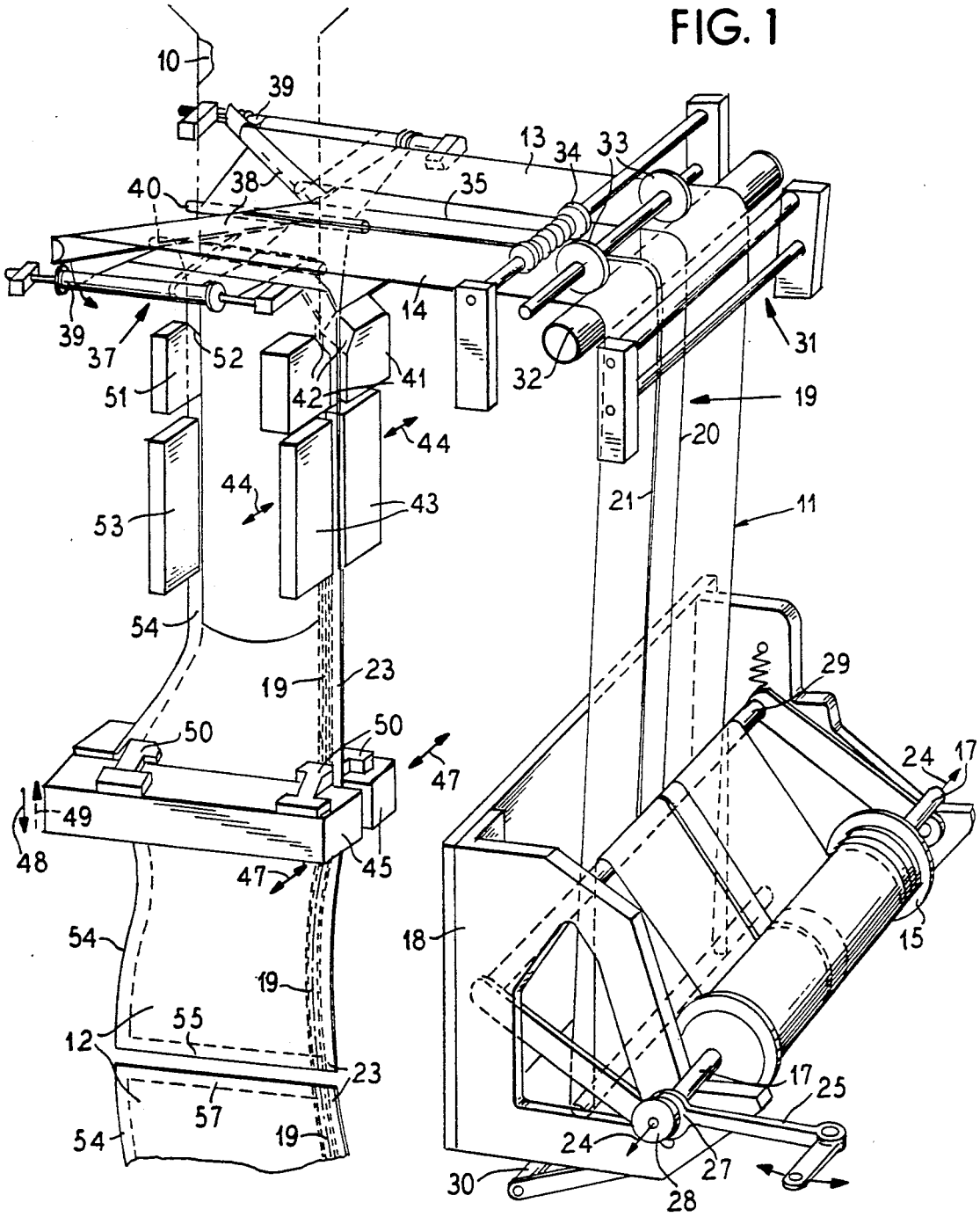
FIG. 1 is a more or less schematic perspective view of a form, fill and seal machine embodying the present invention.

As more or less schematically shown in FIG. 1, a form, fill and seal machine embodying the present invention comprises as a principal element a forming and filling nozzle or tube 10 about which bag or package making material 11 is adapted to be shaped tubularly and advanced package section by package section below the lower discharge or filling end of the tube. The tubularly shaped material is formed into successive packages which receive product contents loaded thereinto from the forming and filling tube 10. In the present instance, the arrangement is such as to produce so-called pillow bags 12 with sealed seams along all four sides.

The material 11 for producing the packages 12 may be supplied in two separate sheet strips 13 and 14 which are guided into cooperative relation along the tube 10 and joined together into tubular form about the tube whereby to provide opposite wall panels for the bag 12.

On the other hand, a convenient manner of supplying the sheet material 11 is in the form of a single sheet of double the width of the strips 13 and 14. To this end, the sheet material 11 is fed from a reel 15 having an axle 17 projecting from opposite ends and supported rotatably on a frame 18 which may be a part of the overall frame for the machine, or may be a separate unit, if desired.

Figure 4:
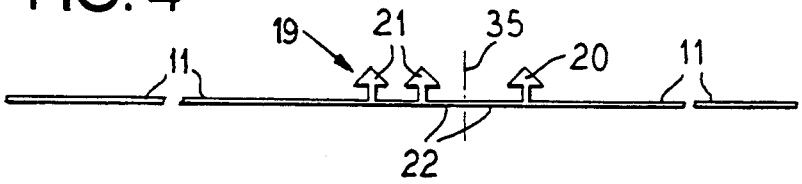
FIG. 4 is a fragmental end edge view of a single sheet of profiled package making film material adapted to be separated into plural strips.
Figure 2:
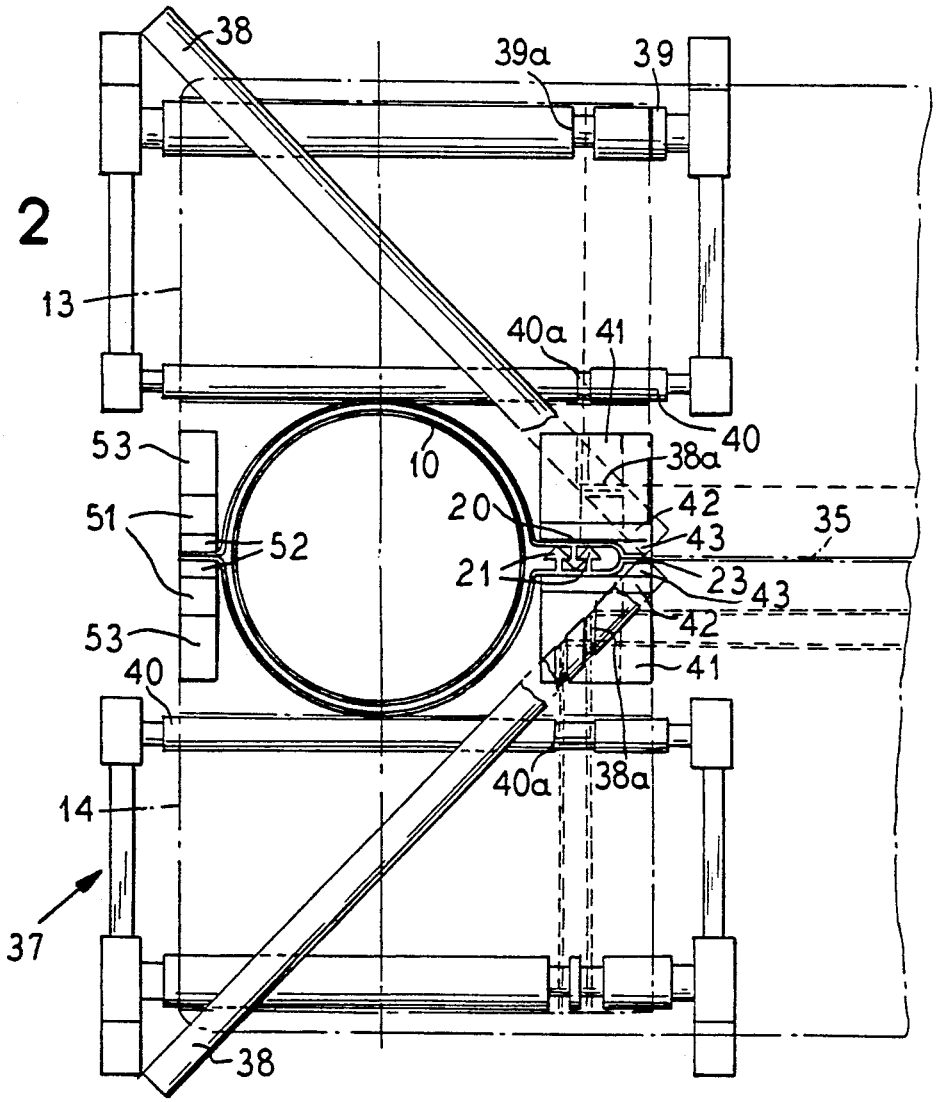
FIG. 2 is a top plan view of the left-hand portion of FIG. 1 and showing the bar system means for guiding separate package making material sheet strips into cooperative relation to the forming and filling tube of the bag making machine.

In this instance, the one-piece continuous sheet material 11 has, speed inwardly from opposite longitudinal edges of the sheet, reclosable fastener means 19 comprising reclosably interlockable resiliently flexible extruded zipper profiles 20 and 21 (FIGS. 1 and 4) which are spaced apart so that they can be folded into interlocked relation, or separated and then interlocked, as best seen in FIG. 2. Desirably, there will be sufficient flange material 22 between the profiles 20 and 21 which can be sealed together as shown in FIGS. 1 and 2 after the profiles are interlocked to provide a sealed seam 23 along one side of the bag or package 12.

In order to avoid piling up of the material 11 on the reel 15 at the profiles 20, 21, the material 11 will have been wound onto the reel 15 in oscillated fashion. However, the material 11 must be directed toward the forming and filing tube 10 in a substantially undeviating straight-line path. Therefore, the reel 15 is mounted in such manner that it can be axially reciprocated as indicated by the arrow 24 so that the material 11 will be paid out in a substantially straight-line direction. Reciprocation of the reel 15 for this purpose may be effected by suitable mechanism such as an oscillating crank 25 which has a shifter coupling 27 engaging a grooved wheel 28 on one end of the axial 17.

In travel from the reel 15, the material 11 is trained over a spring biased dancer 29 and then over a gravity biased dancer 30 and then runs upwardly past guide bars 31 and over a guide roller 32 and is turned in a horizontal direction past guide rollers 33 toward the forming and filing tube 10. As shown, the profiles 21 and 22 are oriented to project upwardly from the horizontally running material.

Figure 3:
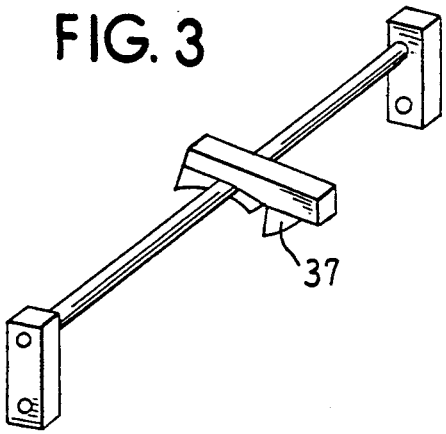
FIG. 3 is a perspective view of an alternate form of slitter for separating a continuous single sheet of package making material into a plurality of strips.

In a preferred arrangement, the package making material 11 is slit, after passing the rollers 32 and 33, into the two strips 13 and 14 by means of a rotary slitter 34 which separates the strips 13 and 14 along a line 35 (FIGS. 1 and 4) intermediate the zipper profiles 20 and 21 so that the zipper profile 20 is on the slit margin of the strip 13 and the complementary zipper profiles 21 are on the slit margins of the strip 14. Instead of a rotary slitter, a fixed knife type of slitter 37 (FIG. 3) may be employed.

New and improved means 37 (FIGS. 1 and 2) are provided for guiding the strips 13 and 14 into cooperative relation along the tube 10, for joining of the strips into tubular form about the tube. To this end, the strips 13 and 14 are directed to run over non-rotary 45° first guide bars 38 from which the strips are respectively run about and under second, rotary guide bars 39 located below the bars 38 and extending on axes which are preferably parallel to the original feed-in direction of the strips 13 and 14. Finally, the strips 13 and 14, running from the respective second guide bars 39, run over and downwardly from spaced parallel rotary third guide bars 40 which are located close to the tube 10. Preferably, the non-rotary bars 38 may be formed from or coated with a substantially friction free material, such as polytetrafluoroethylene.

In running of the strips 13 and 14 over the first guide bars 38, the profiles 20 and 21 project upwardly, that is away from these bars, but the bars 38 have tension relieving, generally spiral grooves 38*a* over which the zipper profile run. As the strips 13 and 14 travel around the roller bars 39, the profiles 20 and 21 face toward these bars, which are provided with respective annular guide grooves 39*a*. These grooves 39*a* besides providing clearance for the profiles, also serve coactively with the profiles 20 and 21 to restrain lateral drifting of the strips 13 and 14. Then the strips 13 and 14 run over the roller bars 40, and the profiles 20 and 21 again project away from these bars, but the bars 40 have tension relieving annular grooves 40*a* over which the zipper profiles run.

After guidance to and along the tube 10, the material strips 13 and 14 are joined into tubular form about the tube. For this purpose, cooperating fixed guiding and zipper closing members 41 receive the profiled margins of the strips 13 and 14 therebetween. Chamfered lead-in surfaces 42 on the upper ends of the confronting sides of the members 41 smoothly lead the profiled margins into and between the members and into interlocking of the profiles 20 and 21. It will be appreciated, of course, that the members 41 may be fixedly supported by adjacent parts of the machine frame (not shown).

Below the members 41, means are provided for sealing the flanges 23 of the strips 13 and 14. For this purpose sealing bars 43 are provided which are cooperatively receiprocated as indicated by the arrow 44 toward and away from one another cyclically for step-by-step sealing of the flanges 23, coordinated with cross-sealing and pull-down bars 45. The bars 45 operate toward and away from one another as indicated by arrows 47 to cross seal the bag making material below the forming and filling tube 10. This effects the sealing of the upper end of the filled package 12 and simultaneously seals the lower end of the succeeding package 12 to be filled. After each succeeding package is filled, the bars 45 pull the just filled package 12 downwardly as indicated by arrow 48 one package length. Then the opened bars 45 return as indicated by arrow 49 to the upper end of the just filled package section 12 and return into sealing engagement with the material. As the sealing bars 45 close, stretching cam pads 50 (see U.S. Pat. No. 4,869,048) effect lateral stretching of the package material to avoid wrinkling at the cross-seal.

At the same time that the members 41 guide the profiled margin of the strips 13 and 14 into jointed relation, guide members 51, having lead-in chamfers 52, guide the margins of the strips 13 and 14 opposite to the profiled margins into face-to-face joined relation as best seen in FIG. 2. Similarly, as the members 41, the members 51 may be stationary and supported by the machine frame. Below the members 51, sealing bars 53, corresponding to the sealing bars 43, seal the associated margins of the package making material and form a side seam seal 54 corresponding generally to the seam provided by the sealed flanges 23.

In the step-by-step operation of the package making machine, the strips 13 and 14, and thereby the sheet of material 11 are drawn toward and about the forming and filling tube by action of the sealing and pull-down bars 45. Coordinated operation of mechanisms such as the sealing bars 43 and 53 and the sealing and pull-down bars 45 is well known in the form, fill and seal machine art.

Not only are the packages 12 provided with the side seals 23 and 54, but by action of the sealing and pull-down bars 45, the packages are provided with cross seals 55 along their lower sides and cross seals 57 along their upper sides so that each package has four sealed sides in the pillow bag format of the packages.

In order to assure thorough sealing at the opposite ends of the zipper 19 of each of the packages 12, the opposite ends may be spot sealed (not shown) in the manner effected in U.S. Pat. No. 4,790,126.

It will be understood that variations and modifications may be effected without departing from the spirit and scope of the novel concepts of the present invention.

I claim as my invention:

1. A form fill and seal bag making mechanism comprising in combination:

support means supporting and feeding a film bag material of two sheets each having first and second peripheral edges and including a profile structure defining pressure interlocking rib and groove members on the sheets adjacent said first peripheral edges and extending in a predetermined direction with respect to said sheets;

a filling tube positioned to receive the film thereabout;

means wrapping the film over the filling tube with said first edges adjacent one another and said second edges one another;

guiding and closing means interlocking said rib and groove members as the sheets are fed over said tube, said guiding and closing means comprising a plurality of guide members, oriented in pairs, in which in each pair a first of said guide members is fixedly mounted and oriented at an angle with respect to the predetermined direction of travel of the respective sheet, a second guide member is rotatably mounted on an axis generally parallel to said predetermined direction of travel of the respective sheet, and a third guide member is rotatably mounted to receive the respective sheet thereover and direct the same parallel to said filling tube, said first guide member reversing the upper and lower surfaces of said sheets and said second and third guide members each including grooves therein for receiving and guiding said rib and groove members for alignment adjacent said filling tube;

first sealing means joining said first edges outwardly of the rib and groove members; and second sealing means joining said second edges of said sheets and located opposite said first sealing means relative to said filling tube so that a bag sleeve is formed for cross-sealing and making a plurality of bags.

2. The form, fill and seal bag making mechanism of claim 1, wherein:

said film is supplied in a single sheet having the rib and groove members spaced apart on said film sheet; and slitting means are included in said support means to slit the film at a location between said rib and groove members to form said first and second sheets.

3. The form, film and seal bag making mechanism of claim 1, wherein:

said wound film is on a roll with the material on the roll oriented in a periodic spaced fashion; and oscillation means are provided for oscillating said support means axially so that said film will be paid out in a substantially straight line direction.

4. The form, fill and seal bag making mechanism of claim 1, wherein: said first guide members comprise angular guide bars positioned at a 45° angle to said predetermined direction of travel of said film for guiding said film onto said filling tube via said second and third guide bars.

5. The form, fill and seal bag making mechanism on claim 4, wherein:

said second and third guide members include spiral grooves for receiving and in which said rib and groove members run as the material is fed onto said filling tube.

6. The form, fill and seal bag making mechanism of claim 2, wherein:

said guiding and closing means includes further members adjacent said filling tube, each of said further members including chamfered lead-in surfaces on the upper ends thereof for smoothly leading the rib and groove members into interlocking relationship.

7. The form, fill and seal bag making mechanism of claim 2, wherein:

said first and second sealing means includes vertical heated sealing bars.

8. The form, fill and seal bag making mechanism of claim 7 and further comprising:

means for reciprocating said sealing bars towards one another cyclically for joining the edges of the film.

9. The form, fill and seal bag making mechanism of claim 8 and further comprising:

cross-sealing and pull-down bars extending laterally of an axis of forward movement of the film and positioned beneath said filling tube for cross-sealing the bag making material and including an arrangement for moving the pull-down bars together to cross-seal the material and coordinate the same with the sealing bars and to move together as the sealing bars move together.

* * * * *